US005411385A

United States Patent [19]

Eto et al.

[11] Patent Number: 5,411,385

[45] Date of Patent: May 2, 1995

[54] ROTARY COMPRESSOR HAVING OIL PASSAGE TO THE BEARINGS

[75] Inventors: Shinya Eto; Yoichi Okawa; Shoichi Simada, all of Tokyo; Makoto Ijiri, Narashino, all of Japan

[73] Assignees: Calsonic Corporation, Tokyo; Seiko Seiki Co., Ltd., Narashino, both of Japan

[21] Appl. No.: 154,027

[22] Filed: Nov. 18, 1993

[30] Foreign Application Priority Data

Nov. 20, 1992 [JP] Japan ..... 4-080531 U

[51] Int. Cl.[6] ..... F04C 18/344; F04C 29/02

[52] U.S. Cl. ..... 418/96; 418/98

[58] Field of Search ..... 418/96–98, 418/93

[56] References Cited

U.S. PATENT DOCUMENTS

| | | | |
|---|---|---|---|
| 4,484,868 | 11/1984 | Shibuya et al. | 418/15 |
| 4,507,065 | 3/1985 | Shibuya et al. | 418/15 |
| 4,875,835 | 10/1989 | Nakajima et al. | 417/295 |

FOREIGN PATENT DOCUMENTS

| | | | |
|---|---|---|---|
| 57-206791 | 12/1982 | Japan | 418/98 |
| 58-47195 | 3/1983 | Japan | 418/98 |
| 59-231190 | 12/1984 | Japan | 418/98 |
| 61-187991 | 11/1986 | Japan . | |

*Primary Examiner*—John J. Vrablik
*Attorney, Agent, or Firm*—Foley & Lardner

[57] ABSTRACT

Two oil passages are defined in a cylinder unit of a rotary compressor for feeding lubrication oil to front and rear bearings. The bearings bear a shaft of a rotor unit relative to the cylinder unit. At least one of the two oil passages is formed with an orifice which is defined by the cylinder unit.

7 Claims, 4 Drawing Sheets

ROTARY COMPRESSOR HAVING OIL PASSAGE TO THE BEARINGS

BACKGROUND OF THE INVENTION

1. Field of the Invention

The present invention relates in general to compressors, and more particularly to compressors of a rotary type which is suitable for use in an automotive air conditioning system. More specifically, the present invention is concerned with rotary compressors of a type in which a measure is employed for adjusting the amount of lubrication oil fed to frictionally engaged members, such as bearings for a rotation shaft and the like.

2. Description of the Prior Art

Hitherto, various rotary compressors have been proposed and put into practical use particularly in the field of automotive air conditioning system.

In order to clarify the task of the present invention, one of the conventional rotary compressors will be described prior to making a detailed description of the present invention.

FIGS. 5 and 6 show the conventional rotary compressor which is disclosed in Japanese Utility Model Second Provisional Publication 61-187991.

As is seen from FIG. 5, the compressor comprises a casing 1 in which a cylinder 2 is stationarily installed. The cylinder 2 is sandwiched between front and rear side blocks 4 and 5. Although not shown, bolts are used for uniting the cylinder 2 and the front and rear side blocks 4 and 5.

As is seen from FIGS. 5 and 6, the cylinder 2 is formed with an oval bore 3 with which a rotor unit 6 is incorporated. The rotor unit 6 comprises a shaft 10 and a rotor proper 7 which is connected to the shaft 10 via spline connection. As is seen from FIG. 6, the rotor proper 7 is rotatably disposed in the oval bore 3 having two crescent clearances defined therebetween. That is, each clearance is defined between an outer surface of the rotor proper 7 and an inner surface 3*a* of the oval bore 3. The rotor proper 7 is formed with five radially extending vane grooves 9 each receiving therein a sliding vane 8.

When the rotor proper 7 is rotated by a drive means such as engine or the like, the sliding vanes 8 are forced to project outward due to generated centrifugal force, which causes tops of the vanes 8 to contact to and slide along the rounded inner surface 3*a* of the oval bore 3. As will be described hereinafter, in addition to the centrifugal force, a hydraulic pressure is constantly applied to rear ends of the sliding vanes 8 to bias the same radially outward under operation of the compressor.

Due to rotation of the rotor proper 7, a coolant is introduced into compression chambers C through an inlet port 11 formed in the casing 1 and an inlet opening 12 formed in the front side block 4, as is indicated by arrows illustrated by broken lines in FIG. 5. Each compression chamber C is defined by adjacent sliding vanes 8, the outer surface of the rotor proper 7 and the inner surface 3*a* of the oval bore 3.

As is seen from FIG. 6, with rotation of the rotor proper 7, each compression chamber C varies the volume and thus the coolant in the compression chamber C is pressurized. As is seen from FIG. 5, the pressurized coolant is then led into a connection passage 15 through a discharge opening 13 of the cylinder 2 against a discharging valve 14. Designated by reference numeral 14*a* is a protection plate for the valve 14. The pressurized coolant flows in the connection passage 15 and impinges against an oil separator 16 which projects into a space "S" defined in the casing 1. The coolant is then discharged to the outside through an outlet port 17.

When the coolant impinges against the oil separator 16, any oil O is separated from the coolant and falls into an oil reservoir 18 which forms a lower portion of the space "S". As shown, the oil reservoir 18 is defined by a bottom wall of the casing 1 and the rear side block 5. Due to the pressure of the pressurized coolant in the oil reservoir 18 as shown by arrows "P", the oil O is forced to flow into both front and rear oil passages 19 and 20. The front passage 19 includes a passage 19*a* formed in the cylinder 2 and a passage 19*b* formed in the front side block 4.

The oil O in the front oil passage 19 is led to a front sliding bearing 22*f* and to a shaft seal 23 and back pressure chambers 24 for the sliding vanes 8. The oil O in the rear oil passage 20 is led to a rear sliding bearing 22*r* and to the back pressure chambers 24.

A lower portion of the rear side block 5 is formed with an oil inlet opening 30 through which the oil O in the oil reservoir 18 is led into the front and rear oil passages 19 and 20. Lubrication of the bearings 22*f* and 22*r* and the sliding vanes 8 is thus achieved.

As shown in FIG. 5, the oil flow from each oil passage 19 or 20 to the back pressure chambers 24 is made through an annular clearance which is defined between the shaft 10 and the front or rear bearing 22*f* or 22*r*. Due to the pressure of the pressurized oil in the back pressure chambers 24 as well as the aforementioned centrifugal force, the sliding vanes 8 are biased radially outward, that is, toward the rounded inner surface 3*a* of the oval bore 3. Some of conventional rotary compressors use a gear pump for pressurizing the oil O in the oil reservoir 18.

The shaft 10 of the rotor unit 6 is constructed of iron, while the front and rear sliding bearings 22*f* and 22*r* are constructed of aluminum. As is known, the sliding bearing 22*f* or 22*r* is so constructed as to vary the amount of oil fed to a given portion in accordance with the size of a clearance defined between the bearing 22*f* or 22*r* and the shaft 10. Accordingly, the amount of oil fed to the sliding bearing and to the given portion varies in accordance with both:

a) the differential pressure between the oil reservoir 18 and the back pressure chambers 24 for the sliding vanes 8, and b) the size of the clearance between the bearing 22*f* or 22*r* and the shaft 10, the size being varied due to a differential thermal expansion and a wearing difference therebetween.

Thus, when the compressor is forced to operate under a highly loaded condition, the temperature of the bearing 22*f* or 22*r* increases and thus the clearance between the bearing and the shaft 10 increases. Thus, in this condition, the oil O which can be reserved in the oil reservoir 18 is reduced, which however induces a possibility of conveying a flash gas to the bearings 22*f* and 22*r* through the oil passages 19 and 20. This phenomenon tends to lower the output power of the rotary compressor.

As is understood from the line "A" of the graph of FIG. 4, the amount of oil O fed to the bearings 22*f* and 22*r* increases in proportion to the temperature of the bearings 22*f* and 22*r*.

As is known, when employed in an automotive air conditioning system, the compressor is subjected to ON/OFF operation for keeping the temperature in a vehicle cabin at a predetermined temperature. However, when the compressor is stopped at the time when the clearance between the bearing 22*f* or 22*r* and the shaft 10 has been increased to a certain degree due to increase in temperature of the interior of the compressor, the oil O is forced to flow from the oil reservoir 18 to an intake chamber 11' through the front oil passage 19 and the front bearing 22*f*. That is, under this condition, the intake chamber 11' is relatively low in pressure. When, thereafter, the compressor is restarted, the oil O in the intake chamber 11' is sucked into the compression chambers C and thus pressurized, so that the force needed for driving the rotor unit 6 is increased temporarily.

When the oil reservoir 18 fails to keep therein a sufficient amount of oil O, the durability of the compressor is lowered. In fact, it tends to occur that the tops of the sliding vanes 8 fail to smoothly contact the rounded inner surface 3*a* of the oval bore 3, which causes generation of noise and vibration of the compressor.

In order to solve the above-mentioned drawbacks, one measure was proposed which is disclosed in U.S. Pat. No. 4,875,835.

In the measure of this Patent, there are employed orifice members which are thrust into oil passages corresponding to the oil passage 19 and 20 of FIG. 5. The oil passages extend obliquely in front and rear side blocks. Due to provision of such orifices, the oil feeding rate to the bearings is reduced, and thus the oil shortage in the oil reservoir is solved. However, even the measure of the Patent has the following new drawbacks.

1) Because the orifice members are separate members thrust into the oil passages, there is the possibility of disconnection of the orifice members from the oil passages. In fact, when the compressor is used in an automotive air conditioning system, vibration of the vehicle tends to increase the possibility.
2) Production of the oil passages is difficult or at least troublesome because of the inclined orientation of them. Furthermore, the work for thrusting the orifice members into such inclined passages is difficult.
3) For achieving a stable settlement of the orifice members in the oil passages, the passages should be machined very precisely.

SUMMARY OF THE INVENTION

It is therefore an object of the present invention to provide a rotary compressor which is free of the above-mentioned drawbacks.

According to the present invention, there is provided a rotary compressor which comprises a casing; a cylinder unit tightly installed in the casing, the cylinder unit having an enclosed rounded bore formed therein; a rotor unit including a shaft and a rotor proper, the shaft extending along an axis of the casing in such a manner that the rotor proper is rotatably disposed in the rounded bore; a plurality of sliding vanes slidably received in radially extending grooves formed in the rotor unit; means for defining an inlet port exposed to compression chambers, each compression chamber being defined by adjacent two sliding vanes, an inner wall of the rounded bore and an outer wall of the rotor proper; means for defining an outlet port exposed to the compression chambers; bearing means for bearing the shaft relative to the cylinder unit; means for defining an oil reservoir in which lubrication oil is reserved; and oil passage means for defining in the cylinder unit at least one oil passage through which the lubrication oil flows from the oil reservoir to the bearing means, wherein the oil passage is formed with an orifice which is defined by the cylinder unit.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
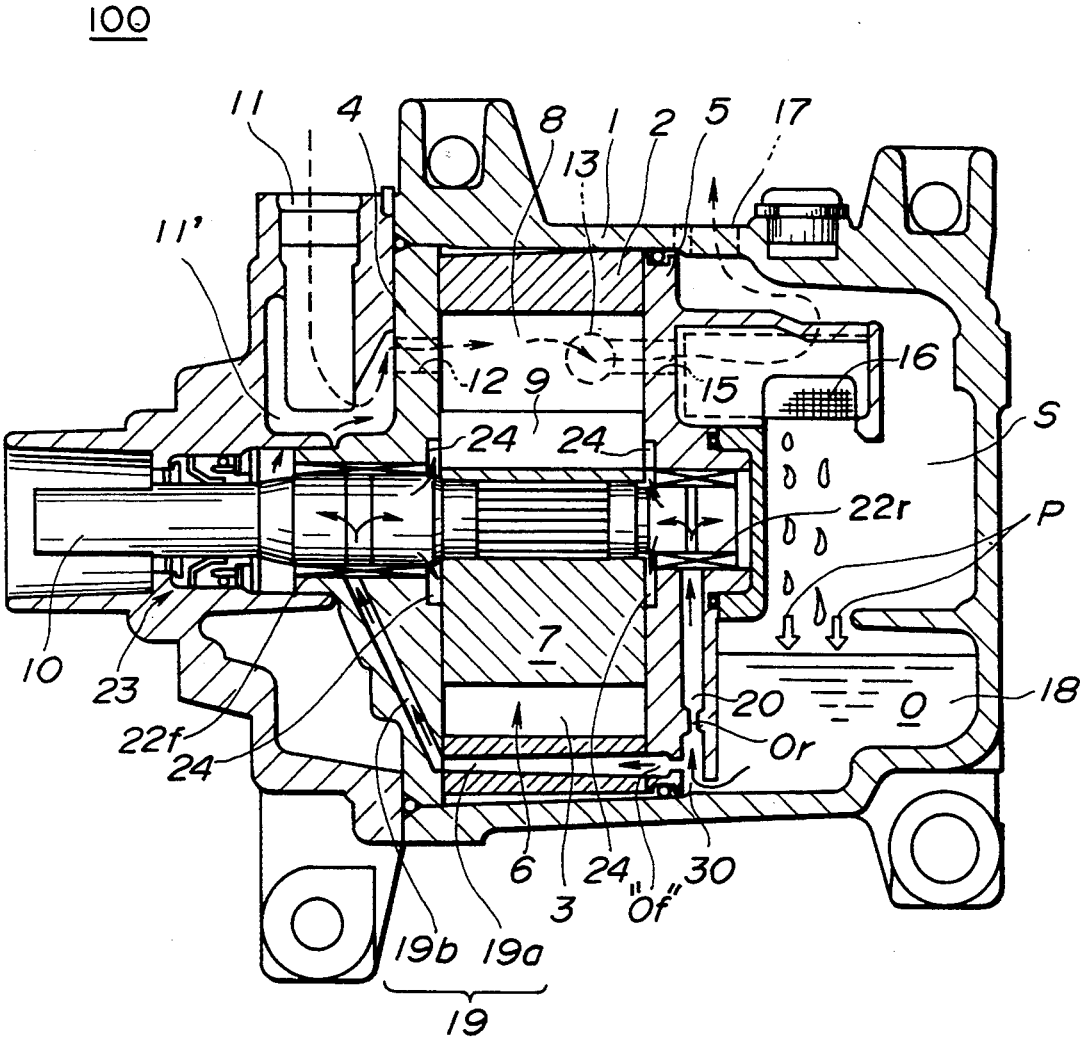
FIG. 1 is a sectional view of a rotary compressor which is a first embodiment of the present invention.

Referring to FIG. 1, there is shown a rotary compressor 100 which is a first embodiment of the present invention.

Figure 6:
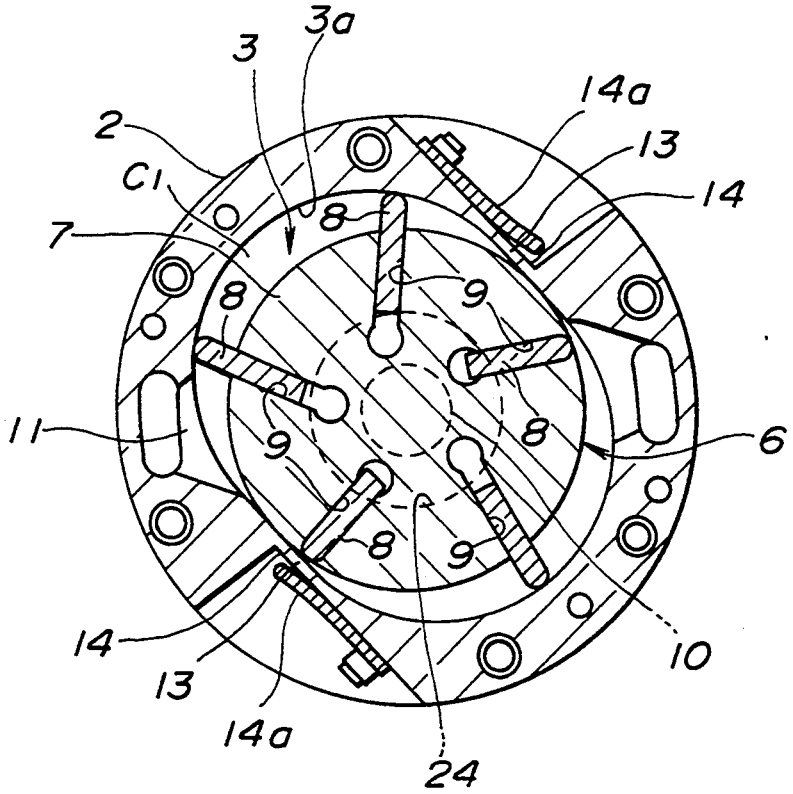
FIG.6 (PRIOR ART)
FIG. 6 is a sectional view taken along the line VI—VI of FIG. 5.
Figure 5:
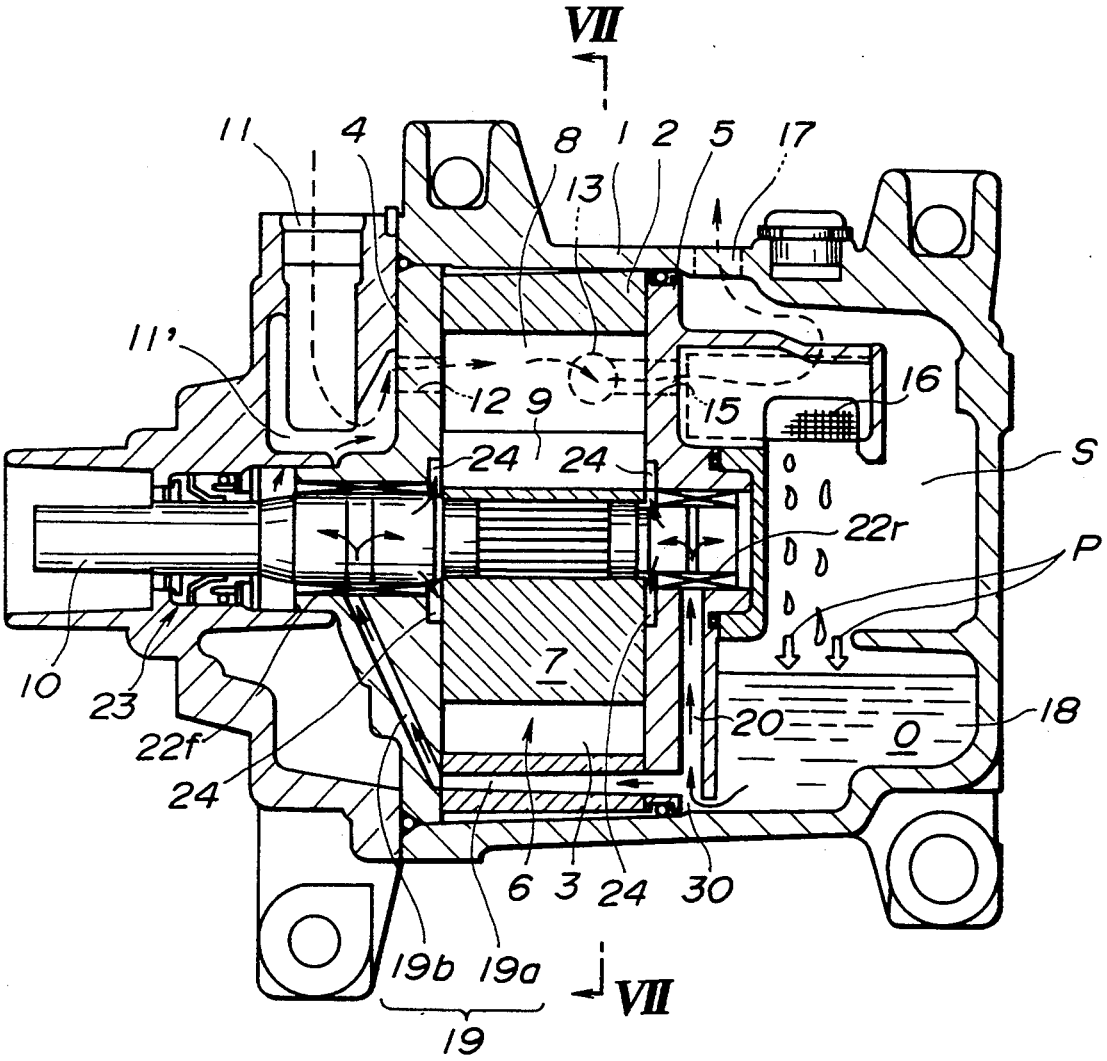
FIG.5 (PRIOR ART)
FIG. 5 is a view similar to FIG. 1, but showing a prior art rotary compressor.

Since the compressor 100 is similar in construction to the above-mentioned conventional compressor of FIGS. 5 and 6, only parts and constructions which are different from those of the conventional ore will be described in the following for ease of description. The same parts and constructions are designed by the same numerals.

In the first embodiment of the present invention, the front and rear oil passages 19 and 20 are respectively formed with orifice portions "Of" and "Or" for controlling the flow of oil O in the oil passages 19 and 20.

It is to be noted that both the orifice portions "Of" and "Or" are defined or formed by the rear side block 5, as is shown in FIG. 1.

Due to provision of the orifice portions "Of" and "Or", it never occurs that excessive amount of oil is fed to the bearings 22*f* and 22*r* from the oil reservoir 18 even when the differential pressure between the oil reservoir 18 and the bearing 22*f* or 22*r* increases and the clearance between the bearing 22*f* or 22*r* and the shaft 10 increases. Furthermore, due to provision of such orifice portions "Of" and "Or", it never occurs that the oil "0" flows toward the intake chamber even when the compressor is stopped at the time when the clearance between the bearing 22*f* or 22*r* and the shaft 10 has been increased due to increase in temperature of the interior of the compressor.

Figure 4:
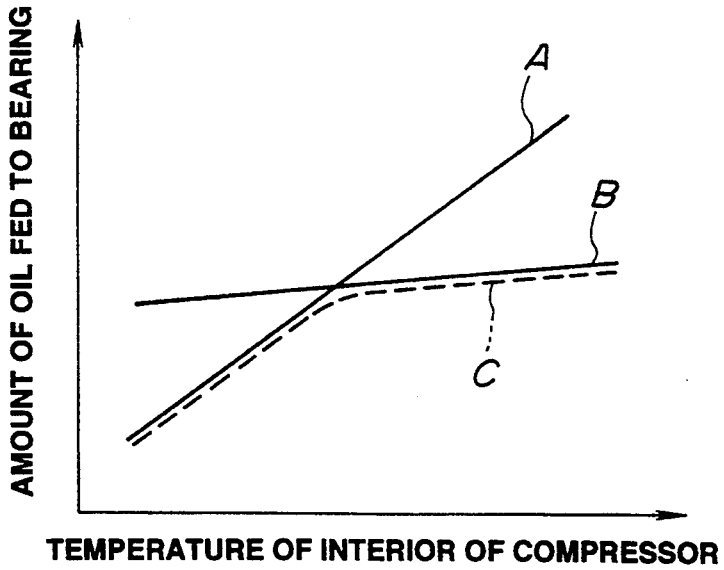
FIG. 4 is a graph showing the performance of the present invention in terms of the relationship between the temperature of the interior of a compressor and the amount of oil fed to a bearing.

These phenomena will be understood from the graph of FIG. 4 in which the solid line "B" shows a case wherein the oil feeding control is carried out by only the orifices "Of" and "Or", and the broken line "C" shows a case wherein the oil feed control is carried out by both the orifices "Of" and "Or" and the clearance between the bearing 22*f* or 22*r* and the shaft 10.

Figure 2:
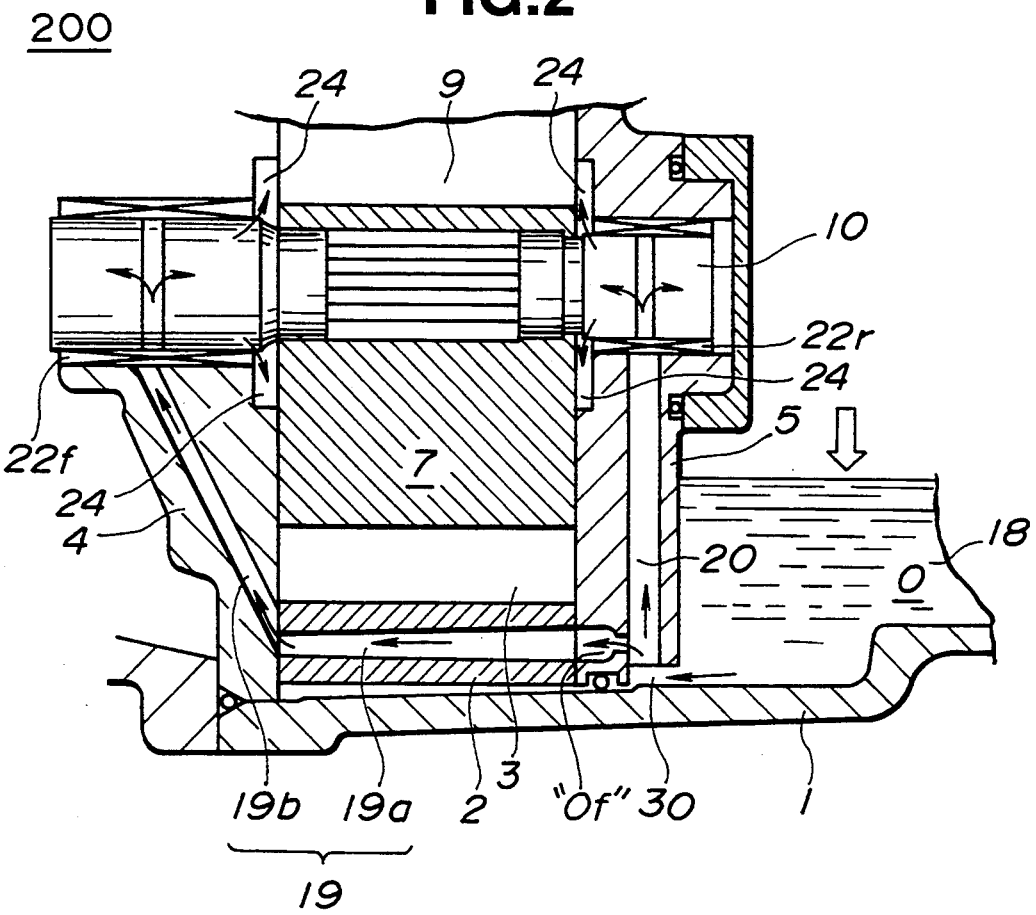
FIG. 2 is an enlarged sectional view of an essential part of a second embodiment of the present invention.

Referring to FIG. 2, there is shown a second embodiment 200 of the invention in which only the front oil passage 19 is formed with the orifice portion "Of". In this embodiment, the amount of oil fed to the rear bearing 22r through the rear oil passage 20 is increased. This is preferable because the rear bearing 22r is more heated than the front bearing 22f because the rear bearing 22r is positioned near the connection passage 15 through which the pressurized and heated coolant flows.

Figure 3:
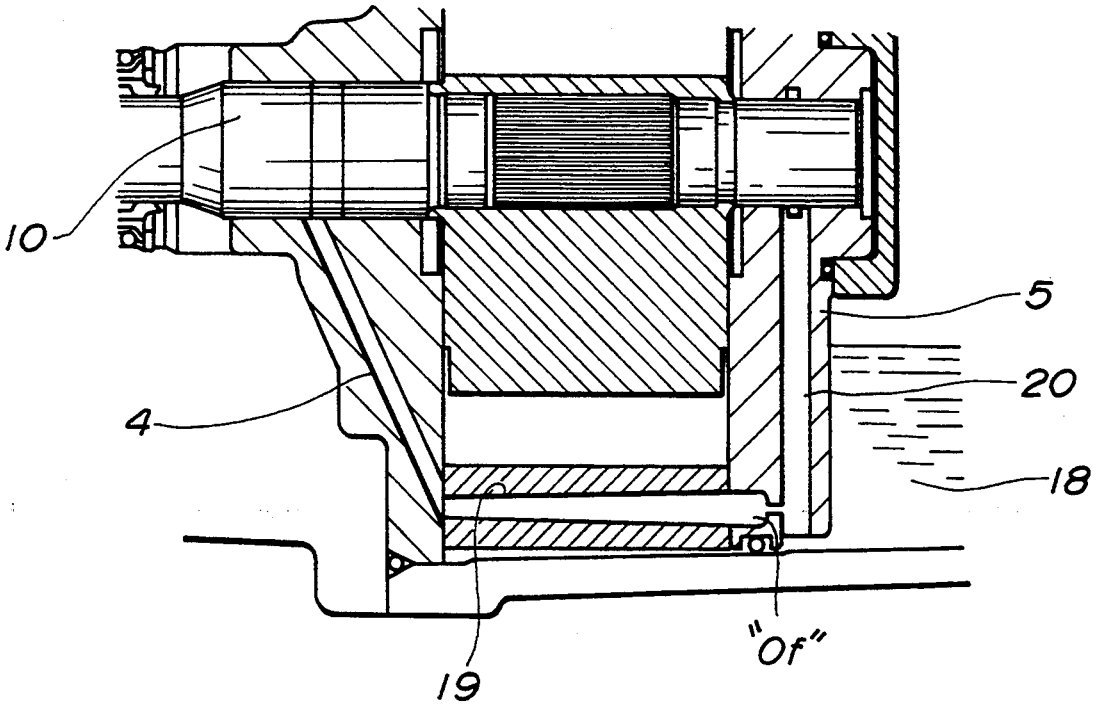
FIG. 3 is a view similar to FIG. 2, but showing a third embodiment of the present invention.

Referring to FIG. 3, there is shown a third embodiment 300 of the present invention. In this embodiment, the front and rear side blocks 4 and 5 are constructed of aluminum, and these side blocks 4 and 6 bear the shaft 10 of the rotor unit 6 by themselves. Of course, lubrication of the bearing portions is effected by the oil "0" led from the oil reservoir 18 through the front and rear oil passages 19 and 20. Only the front oil passage 19 is formed with an orifice portion "Of".

If desired, iron bushes may be used in place of the above-mentioned sliding bearings which are constructed of aluminum.

As will be understood from the foregoing description, in accordance with the present invention, at least one of the oil passages 19 and 20 is formed with an orifice portion "Of" or "Or". Thus, undesired excessive oil feeding to the bearings 22f and 22r is suppressed. Furthermore, since the orifice portion is defined or formed by the rear side block 5, the compressor of the invention is free of the drawbacks possessed by the compressor of the above-mentioned US Patent.

What is claimed is:

1. A rotary compressor comprising:

a casing;

a cylinder unit tightly installed in said casing, said cylinder unit having an enclosed rounded bore formed therein, said cylinder unit including a cylinder, a front side block and a rear side block wherein said cylinder is between said front side block and said rear side block to define said enclosed rounded bore;

a rotor unit including a shaft and a rotor proper mounted on the shaft, said shaft extending along the axis of said rounded bore in such a manner that the rotor proper is rotatably disposed in said rounded bore;

a plurality of sliding vanes slidably received in radially extending grooves formed in said rotor proper;

means defining in said front side block an inlet port exposed to compressor chambers, each compressor chamber being defined by two adjacent sliding vanes, an inner wall of said rounded bore, and an outer wall of said rotor proper;

means defining in said rear side block an outlet port exposed to said compressor chambers;

bearing means for bearing said shaft relative to said front side block and said rear side block of said cylinder unit;

means for defining in said casing an oil reservoir in which lubrication oil is reserved; and means defining in said cylinder, said front side block and said rear side block of said cylinder unit respective oil passages to constitute front and rear oil passages through which said lubrication oil flows from said oil reservoir to both the bearing means at said front side block and said rear side block, wherein said front oil passage is formed with a diametrically reduced portion which acts as an orifice, said diametrically reduced portion being defined by only said rear side block of said cylinder unit.

2. A rotary compressor as claimed in claim 1, in which said bearing means comprises a bearing part defined by said front side block and another bearing part defined by said rear side block, said front and rear side blocks being constructed of aluminum.

3. A rotary compressor as claimed in claim 1, in which said bearing means comprises a front bearing which bears said shaft relative to said front side block and a rear bearing which bears said shaft relative to said rear side block, and in which said oil passage means comprises means for defining a front oil passage which extends from said oil reservoir to said front bearing and means for defining a rear oil passage which extends from said oil reservoir to said rear bearing.

4. A rotary compressor as claimed in claim 3, in which said rear oil passage is formed with a diametrically reduced portion which acts as an orifice, said diametrically reduced portion being defined by only said rear side block.

5. A rotary compressor as claimed in claim 3, in which said front bearing is positioned near said inlet port and said rear bearing is positioned near said outlet port.

6. A rotary compressor as claimed in claim 5, in which said rear side block is formed with a common inlet port through which the oil flows into both said front and rear oil passages.

7. A rotary compressor as claimed in claim 5, in which said front and rear bearings are iron bushes and in which said front and rear side blocks are constructed of aluminum.

* * * * *